US006211865B1

(12) United States Patent
Hosoi et al.

(10) Patent No.: US 6,211,865 B1
(45) Date of Patent: Apr. 3, 2001

(54) DRIVING APPARATUS OF PLASMA DISPLAY PANEL

(75) Inventors: Kenichiro Hosoi; Mitsushi Kitagawa, both of Fukuroi (JP)

(73) Assignee: Pioneer Electronic Corporation, Tokyo (JP)

( * ) Notice: Subject to any disclaimer, the term of this patent is extended or adjusted under 35 U.S.C. 154(b) by 0 days.

(21) Appl. No.: 09/110,383

(22) Filed: Jul. 7, 1998

(30) Foreign Application Priority Data

Aug. 29, 1997 (JP) ..... 9-234138

(51) Int. Cl.[7] ..... G09G 3/10; G09G 3/28; G09G 5/00

(52) U.S. Cl. ..... 345/204; 345/60; 345/62; 345/211; 315/169.1; 315/169.4

(58) Field of Search ..... 345/55, 60, 67, 345/76, 87, 211, 212; 315/169.1, 169.2, 169.3, 169.4

(56) References Cited

U.S. PATENT DOCUMENTS 5,446,344 * 8/1995 Kanazawa ..... 315/169.4
5,654,728 8/1997 Kanazawa et al. ..... 345/68
5,828,353 * 10/1998 Kishi et al. ..... 345/55
5,943,030 * 8/1999 Minamibayshi ..... 345/60
6,034,482 * 3/2000 Kanazawa ..... 315/169.1

* cited by examiner

*Primary Examiner*—Bipin Shalwala
*Assistant Examiner*—David L Lewis
(74) *Attorney, Agent, or Firm*—Morgan, Lewis & Bockius LLP

(57) ABSTRACT

A driving apparatus of a plasma display panel which can apply a plurality of driving pulses of different polarities onto same row electrodes of the PDP by a transistor of a low withstanding voltage. The apparatus has a first pulse generating circuit for generating a first pulse of a predetermined polarity and applying it to a first line and a second pulse generating circuit for generating a second pulse of a polarity different from the predetermined polarity and applying it to the row electrodes of the plasma display panel. A switching device which is turned on for at least a period of time when the first pulse generating circuit generates the first pulse and connects the first line and the row electrodes is provided between the first and second pulse generating circuits.

9 Claims, 11 Drawing Sheets

GT1
1

GT2
0

GT3
0

GT4
0

GT5
0

GT6
1

IPy
ROW ELECTRODE
DRIVING SIGNAL
0
RPy

GT1
1

GT2
0

GT3
0

GT4
0

GT5
0

GT7
0

IPy
ROW ELECTRODE
DRIVING SIGNAL
0
RPy

GT1
1

GT2
0

GT3
0

GT4
0

GT5
0

GT7
0

GT8
0

GT9
0

ROW ELECTRODE DRIVING SIGNAL
IPy
0
RPy

DRIVING APPARATUS OF PLASMA DISPLAY PANEL

BACKGROUND OF THE INVENTION

1. Field of the Invention

The invention relates to a driving apparatus of a plasma display panel.

2. Description of Related Art

As a flat display apparatus, a plasma display panel (hereinafter, referred to as a PDP) of an AC (alternating current discharge) type is known.

Although the AC type plasma display panel performs a display by supplying various pulses to row electrodes and column electrodes which are arranged so as to perpendicularly cross each other, there is a problem that a high-withstand voltage transistor which can withstand a potential difference of a power source has to be used in a pulse generating circuit.

OBJECT AND SUMMARY OF THE INVENTION

The invention has been made to solve the problem described above, and it is an object of the invention to provide a driving apparatus of a plasma display panel in which a plurality of driving pulses having different polarities can be supplied to the same row electrodes of a PDP by a transistor having a relatively low withstanding voltage.

According to the first aspect of the invention, there is provided a driving apparatus of a plasma display panel, comprising: column electrode driving means for supplying pixel data pulses corresponding to pixel data to a plurality of column electrodes arranged in the vertical direction of the plasma display panel; and row electrode driving means for supplying first pulses of a predetermined polarity and second pulses of a polarity different from the predetermined polarity to a plurality of row electrodes which cross the column electrodes and are arranged in the horizontal direction, wherein the column electrode driving means has: a first pulse generating circuit for generating the first pulses and supplying them to a first line; a second pulse generating circuit for generating the second pulses and supplying them to the row electrodes; and a switching element which is turned on at least for a period of time during which the first pulse generating circuit generates the first pulses, thereby connecting the first line and the row electrodes.

According to the second aspect of the invention, there is provided a driving apparatus of a plasma display panel, comprising: column electrode driving means for supplying pixel data pulses corresponding to pixel data to a plurality of column electrodes arranged in the vertical direction of the plasma display panel; and row electrode driving means for supplying first pulses of a predetermined polarity and second pulses of a polarity different from the predetermined polarity to a plurality of row electrodes arranged in the horizontal direction which crosses the column electrodes, wherein the row electrode driving means has: a first pulse generating circuit for generating the first pulses and supplying them to a first line; a first switching element which is turned on at least for a period of time during which the first pulse generating circuit generates the first pulses, thereby connecting the first line and the row electrodes; a second pulse generating circuit for generating the second pulses and supplying them to a second line; and a second switching element which is turned on at least for a period of time during which the second pulse generating circuit generates the second pulses, thereby connecting the second line and the row electrodes.

DETAILED DESCRIPTION OF THE PREFERRED EMBODIMENTS

An example of a conventional plasma display apparatus will now be described with reference to the drawings prior to an explanation of an embodiment of the invention.

Figure 1:
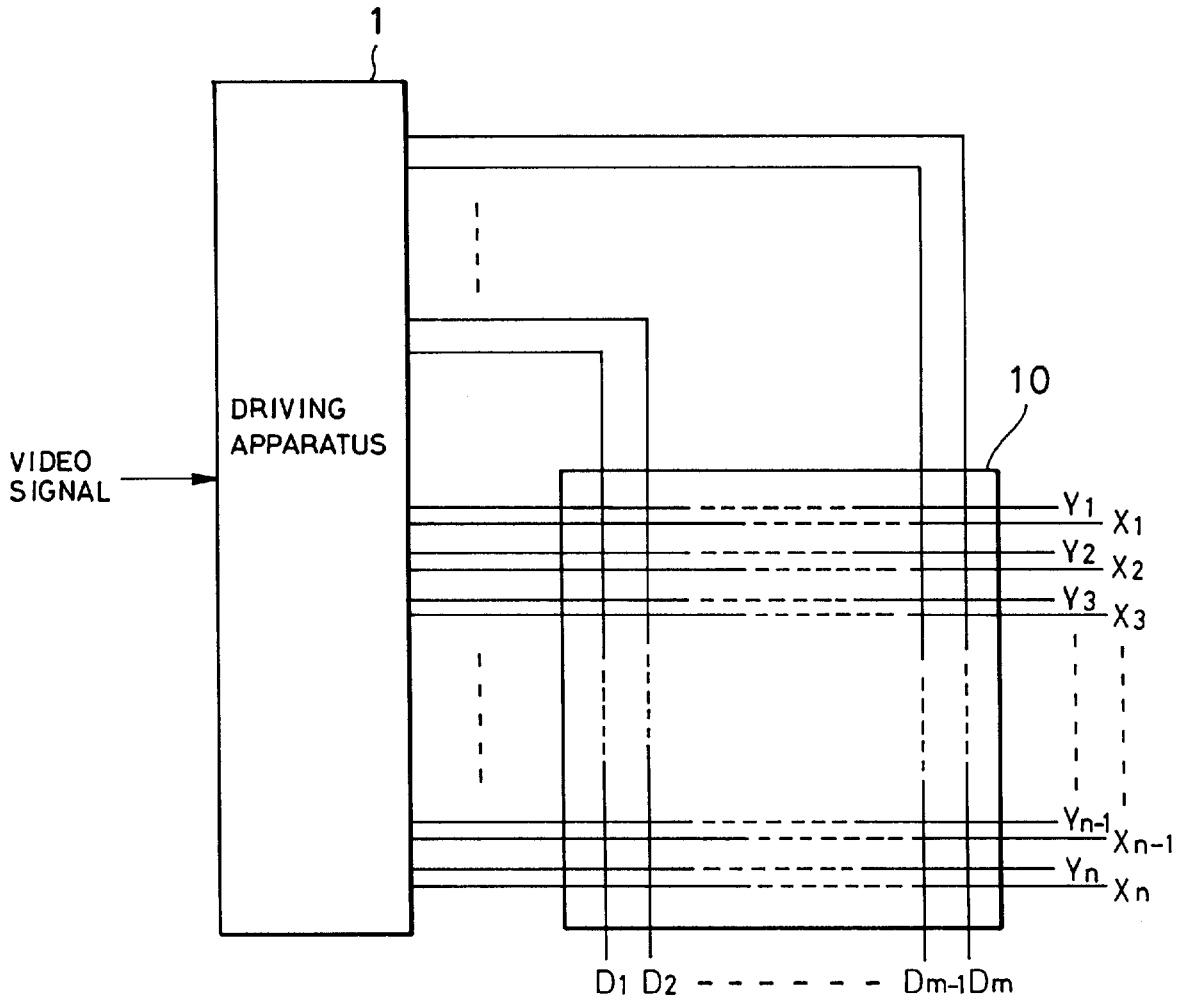
FIG. 1 is a diagram showing a schematic construction of a plasma display apparatus.

FIG. 1 is a diagram showing a schematic construction of a plasma display apparatus including a driving apparatus for driving the AC type PDP.

In FIG. 1, in a PDP 10, row electrodes $Y_1$ to $Y_n$ and row electrodes $X_1$ to $X_n$ in which a pair of X and Y construct a row electrode pair corresponding to the rows (the first to n-th rows) of one screen are formed. Further, column electrodes $D_1$ to $D_m$ serving as column electrodes which perpendicularly cross those row electrode pairs and correspond to the columns (the first to m-th columns) of one screen so as to sandwich a dielectric layer and a discharge space (they are not shown) are formed. In this instance, one discharge cell is formed at a crossing portion of one row electrode pair (X, Y) and one column electrode D. A driving apparatus 1 converts a supplied video signal into pixel data of N bits of every pixel, converts the pixel data into m pixel data pulses every row in the PDP 10, and supplies the pulses to the column electrodes $D_1$ to $D_m$ of the PDP 10. Further, the driving apparatus 1 forms row electrode driving signals including a reset pulse RPx, reset pulse RPy, a priming pulse PP, a scanning pulse SP, a maintaining pulse IPx, maintaining pulse IPy, and an erasing pulse EP at timings as shown in FIGS. 2A to 2F and supplies those signals to the row electrode pairs ($Y_1$ to $Y_n$, $X_1$ to $X_n$) of the PDP 10.

In FIGS. 2A to 2F, the driving apparatus 1 first generates the reset pulse RPx of a positive voltage and supplies it to all of the row electrodes $X_1$ to $X_n$ and, simultaneously, generates the reset pulse RPy of a negative voltage and supplies it to the row electrodes $Y_1$ to $Y_n$, respectively (all-resetting process).

By supplying the reset pulses, all of the discharge cells of the PDP 10 are discharged and excited, so that charged particles are generated. After completion of the discharge, wall charges of a predetermined amount are uniformly formed in the dielectric layers of all of the discharge cells.

Figures 2A, 2B, 2C, 2D, 2E, 2F:
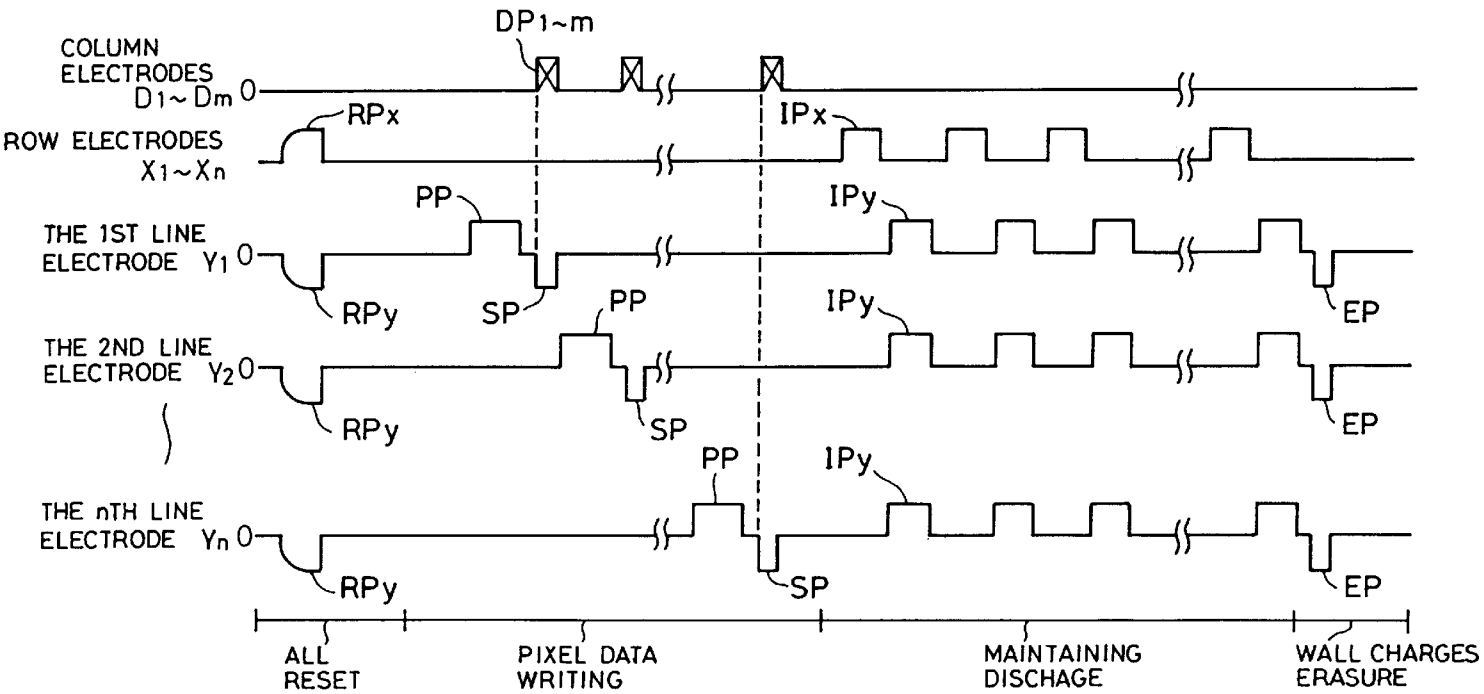
FIGS. 2A to 2F are diagrams showing timings of row electrode driving signals by a driving apparatus in FIG. 1.

Subsequently, the driving apparatus 1 generates pixel data pulses $DP_1$ to $DP_m$ of a positive voltages corresponding to pixel data of every row and sequentially supplies the pulses to the column electrodes $D_1$ to $D_m$ every row, Further, the driving apparatus 1 generates a scanning pulse SP each having a negative voltage and a relatively small pulse width at the same timing as that at which the pixel data pulses $DP_1$ to $DP_m$ are supplied to the column electrodes $D_1$ to $D_m$. The driving apparatus sequentially supplies the scanning pulses SP to the row electrodes $Y_1$ to $Y_n$ as shown in FIGS. 2C to 2E. At this time, among the discharge cells existing in the row electrodes to which the scanning pulses SP were supplied, the discharge occurs in the discharge cell to which the pixel data pulse of a high voltage was supplied, so that most of the wall charges are lost. Since no discharge occurs in the discharge cell to which the pixel data pulse is not supplied, the wall charges remain as they are. That is, whether the wall charges remain in each discharge cell or not is determined in accordance with the pixel data pulse supplied to the column electrode. This means that the pixel data has been written to each discharge cell in response to the supply of the scanning pulse SP. The driving apparatus 1 supplies priming pulses PP of a positive voltage as shown in FIGS. 2C to 2E to the row electrodes $Y_1$ to $Y_n$ just before the scanning pulses SP of a negative voltage are supplied to the row electrodes Y (pixel data writing process).

By the supply of the priming pulses PP, the charged particles which were obtained by the all-resetting operation and were decreased together with the elapse of time are formed again in a discharge space of the PDP 10. The writing of the pixel data by the supply of the scanning pulses SP is executed in a period of time while the charged particles exist.

The driving apparatus 1 continuously supplies the maintaining pulses IPy of the positive voltage to the row electrodes $Y_1$ to $Y_n$, respectively, and successively supplies the maintaining pulses IPx of the positive voltage to the row electrodes $X_1$ to $X_n$ at timings deviated from the supplying timings of the maintaining pulses IPy, respectively (maintaining discharging process).

The discharge cell in which the wall charges remain as they are repeats the discharge light emission and maintains the light emitting state for a period of time while the maintaining pulses IPx and IPy are alternately supplied.

The driving apparatus 1 generates the erasing pulses EP of the negative voltage and simultaneously supplies them to the row electrodes $Y_1$ to $Y_n$, thereby erasing the wall charges remaining in each discharge cell (wall charge erasing process).

Figure 3:
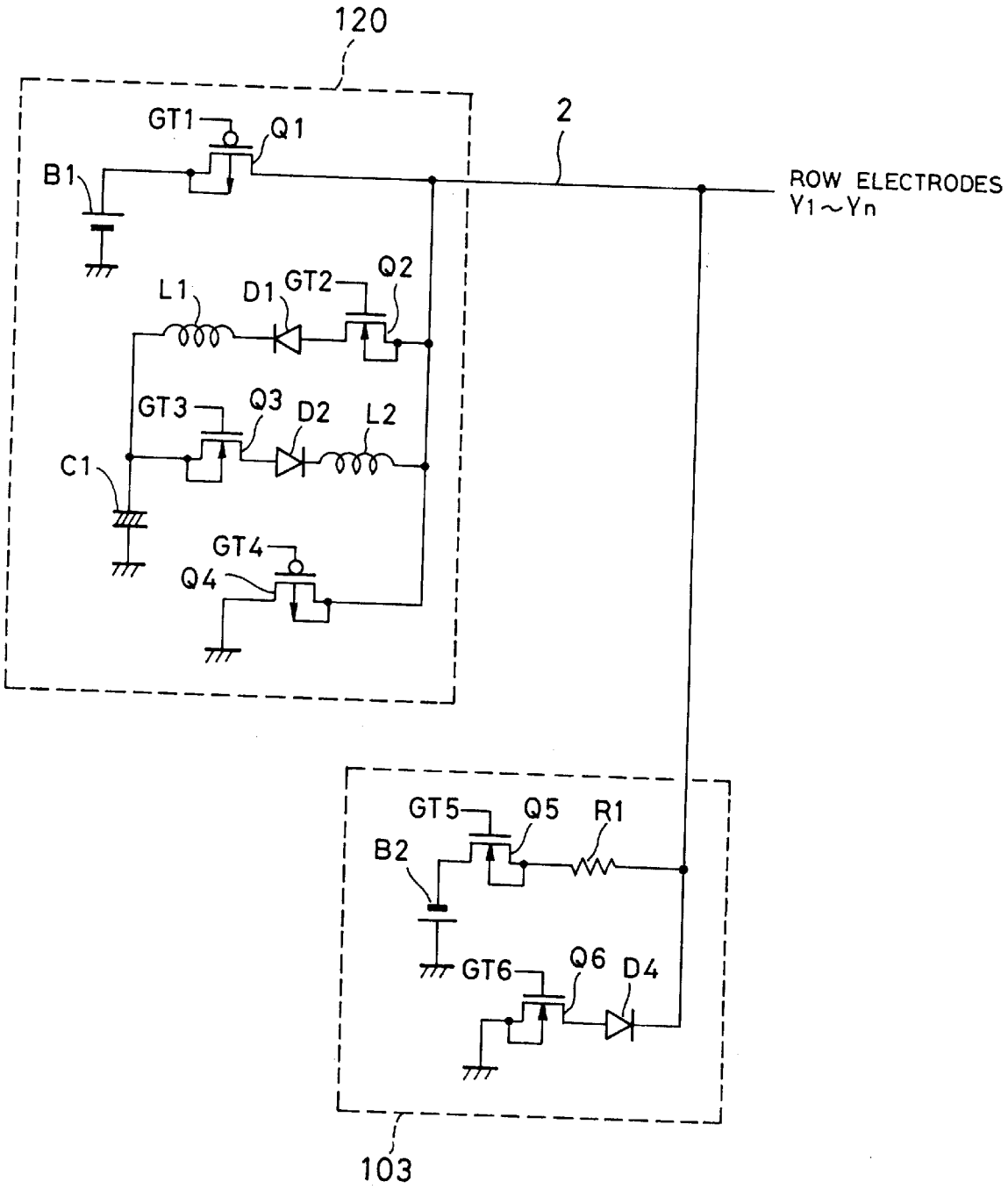
FIG. 3 is a diagram showing a construction of a conventional pulse driving circuit for generating a reset pulse RPy and a maintaining pulse IPy.

FIG. 3 is a diagram showing a construction of the pulse driving circuit for generating the reset pulse RPy and maintaining pulse IPy among the various driving pulses.

In FIG. 3, a p-channel type MOS (Metal Oxide Semiconductor) transistor Q1 in a maintaining pulse generating circuit 120 is turned off when a logic level of a gate signal GT1 supplied to its gate terminal is equal to "1". When the logic level of the gate signal GT1 is equal to "0", the MOS transistor Q1 is turned on and supplies a potential of a positive side terminal of a DC power source B1 to a line 2. A negative side terminal of the DC power source B1 is connected to the ground. Further, a capacitor C1 whose one end is connected to the ground is provided for the maintaining pulse generating circuit 120. An n-channel type MOS transistor Q2 is turned off when a logic level of a gate signal GT2 supplied to its gate terminal is equal to "0". When the logic level of the gate signal GT2 is equal to "1", the transistor Q2 is turned on and supplies the electric potential on the line 2 to another end of the capacitor C1 through a diode D1 and a coil L1. An n-channel type MOS transistor Q3 is turned off when a logic level of a gate signal GT3 supplied to its gate terminal is equal to "0". When the logic level of the gate signal GT3 is equal to "1", the transistor Q3 is turned on and supplies the electric potential generated at the other end of the capacitor C1 onto the line 2 via a diode D2 and a coil L2. A p-channel type MOS transistor Q4 is turned off when a logic level of a gate signal GT4 supplied to its gate terminal is equal to "1". When the logic level of the gate signal GT4 is equal to "0", the transistor Q4 is turned on and pulls the electric potential on the line 2 into the ground potential via a diode D3.

An n-channel type MOS transistor Q5 in a reset pulse generating circuit 103 is turned off when a logic level of a gate signal GT5 supplied to its gate terminal is equal to "0". When the logic level of the gate signal GT5 is equal to "1", the MOS transistor Q5 is turned on and supplies an electric potential at a negative side terminal of a DC power source B2 onto the line 2 through a resistor R1. A positive side terminal of the DC power source B2 is connected to the ground. An n-channel type MOS transistor Q6 is turned off when a logic level of a gate signal GT6 supplied to its gate terminal is equal to "0". When the logic level of the gate signal GT6 is equal to "1", the MOS transistor Q6 is turned on and pulls the electric potential on the line 2 into the ground potential through a diode D4.

The diodes D1 to D4 are provided to prevent a reverse current.

FIGS. 4A to 4G are diagrams showing respective supplying timings of the gate signals GT1 to GT6 when the reset pulses RPy and maintaining pulses IPy as shown in FIGS. 2C to 2E are generated, respectively.

Figures 4A, 4B, 4C, 4D, 4E, 4F, 4G:
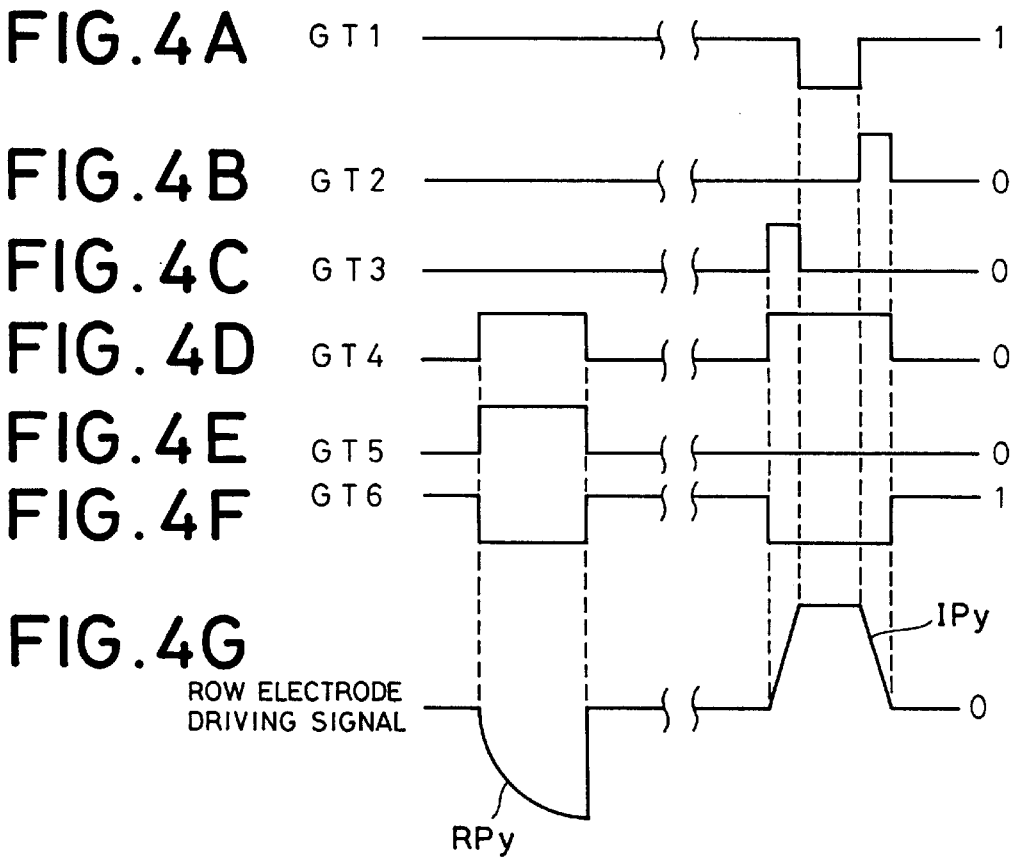
FIGS. 4A to 4G are diagrams showing timings of respective gate signals when the reset pulse RPy and maintaining pulse IPy are generated by the conventional pulse driving circuit.

As shown in FIG. 4E, the MOS transistor Q5 is first turned on in response to the gate signal GT5 at the logic level "1". A negative electric potential generated at the negative side terminal of the DC power source B2 is, therefore, applied to the line 2 and the reset pulse RPy having a negative voltage as shown in FIG. 4G is generated.

As shown in FIGS. 4B and 4C, since the logic level of the gate signal GT3 is sequentially switched to "0"→"1"→"0" and the logic level of the gate signal GT3 is sequentially switched to "0"→"1"→"0" and, further, the logic level of the gate signal GT2 is sequentially switched to "0"→"1"→"0", the maintaining pulse IPy of a positive voltage shown in FIG. 4G is generated. That is, in response to the gate signal GT3 at the logic level "1", the MOS transistor Q3 is turned on and the current according to the charges accumulated in the capacitor C1 flows onto the line 2 through the MOS transistor Q3, diode D2, and coil L2. The level of the row electrode driving signal on the line 2, therefore, gradually rises as shown in FIG. 4G. The MOS transistor Q1 is subsequently turned on in response to the gate signal GT1 at the logic level "1". The positive electric potential at the positive side terminal of the DC power source B1 is, thus, applied to the line 2 and the maintaining pulse IPy having a positive voltage as shown in FIG. 4G is generated. The MOS transistor Q2 is subsequently turned on in response to the gate signal GT2 at the logic level "1", so that the current according to the charges charged in the PDP 10 flows into the capacitor C1 through the MOS transistor Q2, diode D1, and coil L1. The level of the maintaining pulse IPy gradually drops as shown in FIG. 4G by the charging operation of the capacitor C1.

As mentioned above, the reset pulse generating circuit 103 and maintaining pulse generating circuit 120 generate driving pulses (reset pulse RPy, maintaining pulse IPy) having different polarities and those driving pulses are applied onto the common line 2 at different timings.

In the construction shown in FIG. 3, the MOS transistors Q1 and Q5 are serially connected between the positive side terminal of the DC power source B1 and the negative side terminal of the DC power source B2. Further, the MOS transistors Q2 (Q3) and Q5 are serially connected between capacitor C1 for generating almost the same electric potential as that of the positive side terminal of the DC power source B1 and the negative side terminal of the DC power source B2.

There is, consequently, a problem such that as MOS transistors Q1 to Q3 and Q4 shown in FIG. 3, transistors having a high withstanding voltage which can endure a potential difference between the potential at the positive side terminal of the DC power source B1 and the negative side terminal potential of the DC power source B2 have to be used.

An embodiment of the invention will now be described hereinbelow with reference to the drawings.

Figure 5:
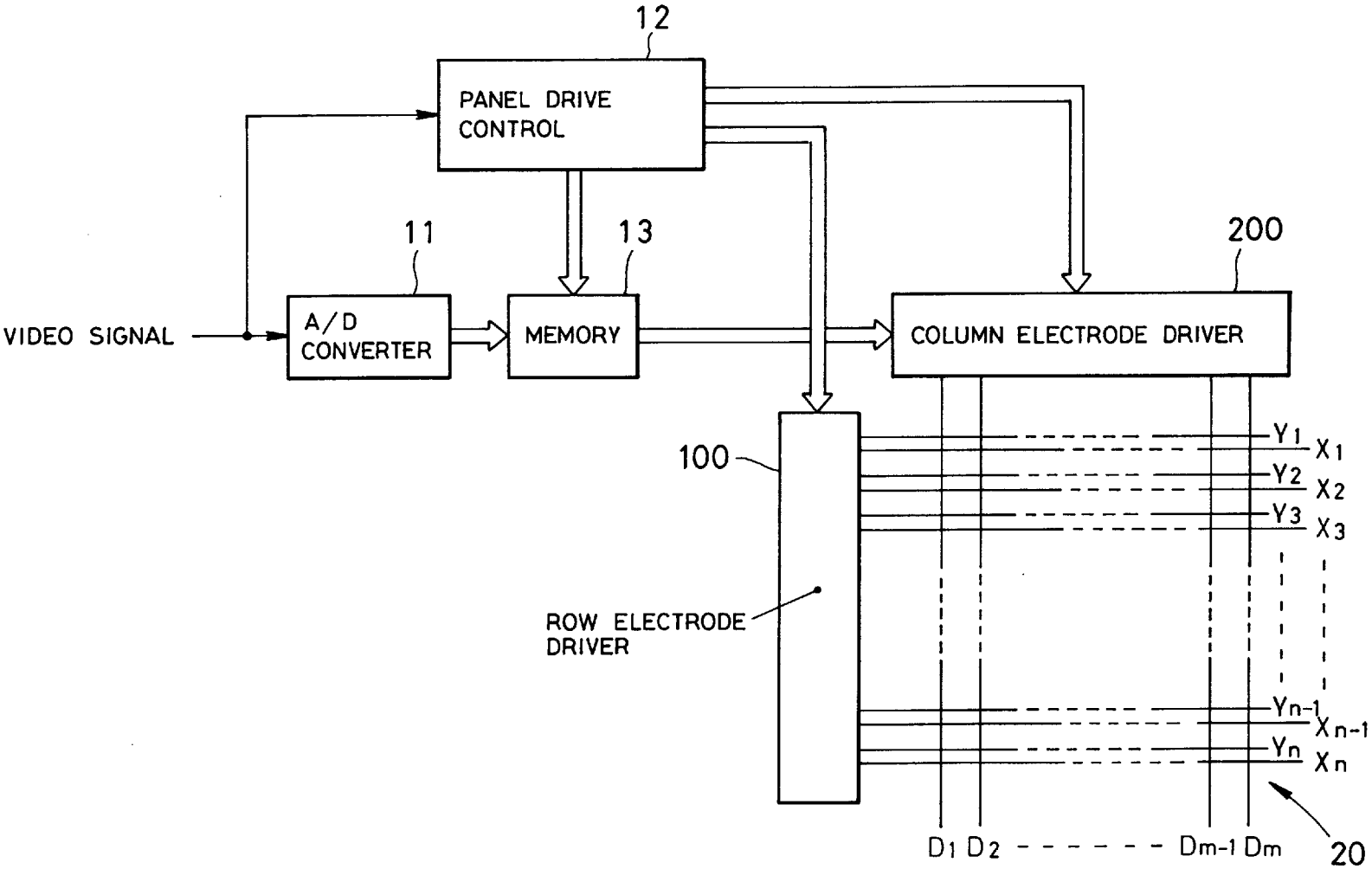
FIG. 5 is a diagram showing a whole construction of a plasma display apparatus including a driving apparatus according to the invention.

FIG. 5 is a diagram showing a whole construction of a plasma display apparatus including a driving apparatus according to the invention.

In FIG. 5, an A/D converter 11 samples a supplied analog video signal, converts it into pixel data of N bits every pixel, and supplies it into a memory 13. A panel drive control circuit 12 detects a horizontal sync signal and a vertical sync signal included in the video signal, generates various signals as will be explained hereinafter on the basis of the detection timings, and supplies them to the memory 13, a row electrode driver 100, and a column electrode driver 200, respectively.

The memory 13 sequentially writes the pixel data in response to a write signal supplied from the panel drive control circuit 12. The memory 13 further reads out the pixel data written as mentioned above every row of a PDP (plasma display panel) 20 in response to a read signal supplied from the panel drive control circuit 12 and supplies them to the column electrode driver 200.

The row electrodes $Y_1$ to $Y_n$ and row electrodes $X_1$ to $X_n$ in which a row electrode pair corresponding to each row (the first row to the n-th row) of one screen is constructed by a pair of X and Y are formed in the PDP 20. Further, column electrodes $D_1$ to $D_m$ serving as column electrodes corresponding to each column (the first column to the m-th column) of one screen are formed so as to perpendicularly cross the row electrode pairs and sandwich a dielectric layer and a discharge space (not shown). In this instance, one discharge cell is formed at an intersecting portion between one row electrode pair (X, Y) and one column electrode D.

The column electrode driver 200 generates the pixel data pulses $DP_1$ to $DP_m$ corresponding to each of the pixel data of one row which are supplied from the memory 13 and supplies those pulses to the column electrodes $D_1$ to $D_m$ of the PDP 20 as shown in FIGS. 6A to 6F in response to a pixel data pulse applying timing signal supplied from the panel drive control circuit 12, respectively.

Figures 6A, 6B, 6C, 6D, 6E, 6F:
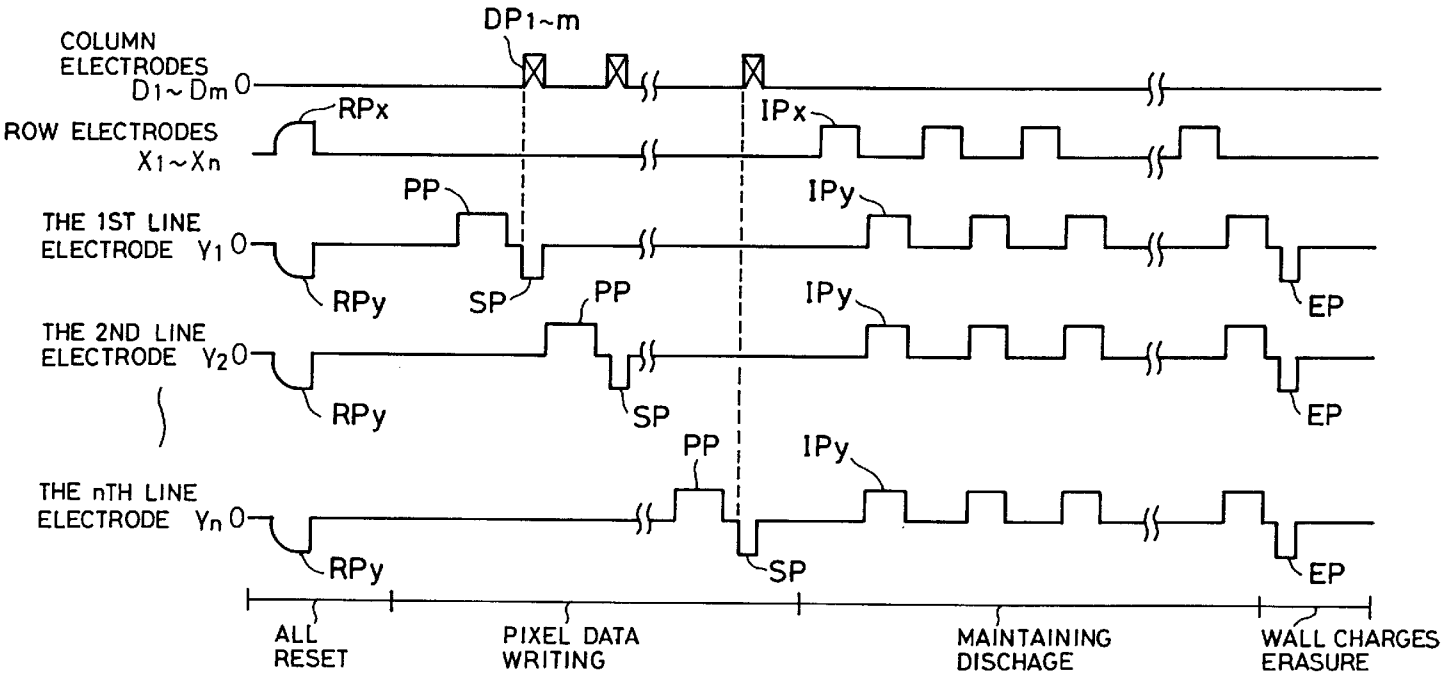
FIGS. 6A to 6F are diagrams showing timings of the row electrode driving signals by the driving apparatus in FIG. 5.

In response to various timing signals which are supplied from the panel drive control circuit 12, the row electrode driver 100 generates a row electrode X driving signal including the reset pulse RPx and maintaining pulse IPx as shown in FIG. 6B and simultaneously supplies it to the row electrodes $X_1$ to $X_n$ of the PDP 20, respectively. In accordance with the various timing signals supplied from the panel drive control circuit 12, the row electrode driver 100 generates a row electrode Y driving signal including the reset pulse RPy of a negative voltage, priming pulse PP of a positive voltage, scanning pulse SP of a negative voltage, maintaining pulse IPy of a positive voltage, and erasing pulse EP of a negative voltage as shown in FIGS. 6C to 6E and supplies it to the row electrodes $Y_1$ to $Y_n$ of the PDP 20, respectively.

Figure 7:
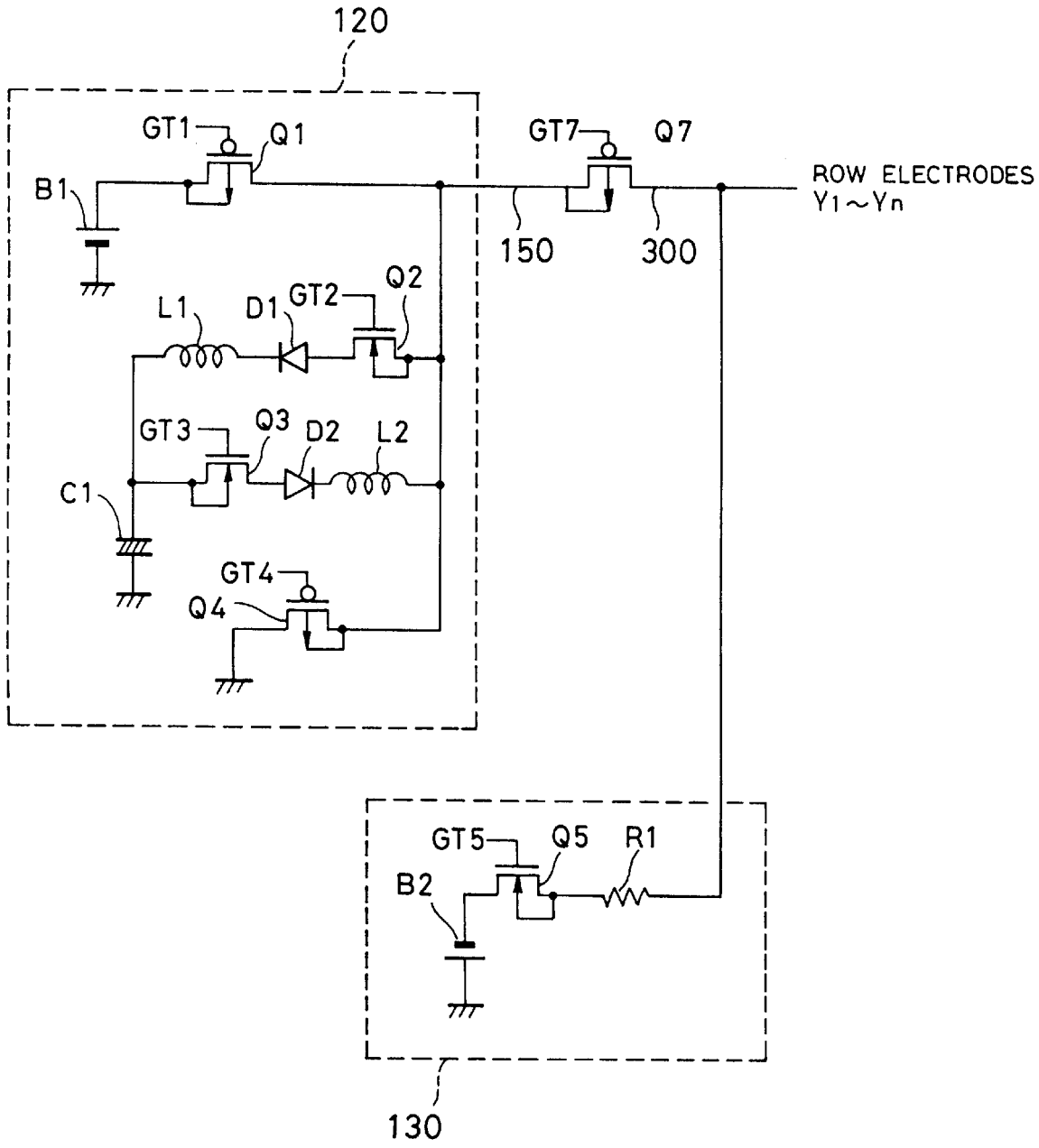
FIG. 7 is a diagram showing a construction of a pulse driving circuit based on the driving apparatus of the invention.

FIG. 7 is a diagram showing a construction of a pulse driving circuit based on the driving apparatus of the invention formed so as to generate the reset pulse RPy and maintaining pulse IPy among the above various driving pulses, respectively. The construction shown in FIG. 7 is provided in the row electrode driver 100.

In FIG. 7, the p-channel type MOS (Metal Oxide Semiconductor) transistor Q1 in the maintaining pulse generating circuit 120 is turned off when the logic level of the gate signal GT1 supplied from the panel drive control circuit 12 is equal to "1". When the logic level of the gate signal GT1 is equal to "0", the MOS transistor Q1 is turned on and the electric potential at the positive side terminal of the DC power source B1 is applied onto a line 150. The negative side terminal of the DC power source B1 is connected to the ground. Further, the maintaining pulse generating circuit 120 has the capacitor C1 one end of which is connected to the ground. The n-channel type MOS transistor Q2 is turned off when the logic level of the gate signal GT2 supplied from the panel drive control circuit 12 is equal to "0". When the logic level of the gate signal GT2 is equal to "1", the MOS transistor Q2 is turned on and an electric potential on the line 150 is applied to the other end of the capacitor C1 via the diode D1 and coil L1, thereby charging the capacitor C1. The n-channel type MOS transistor Q3 is turned off when the logic level of the gate signal GT3 supplied from the panel drive control circuit 12 is equal to "0". When the logic level of the gate signal GT3 is equal to "1", the MOS transistor Q3 is turned on and the electric potential discharged from the other end of the capacitor C1 is applied onto the line 150 via the diode D2 and coil L2. When the logic level of the gate signal GT4 supplied from the panel drive control circuit 12 is equal to "1", the p-channel type MOS transistor Q4 is turned off. When the logic level of the gate signal GT4 is equal to "0", the MOS transistor Q4 is turned on, thereby pulling the electric potential on the line 150 into the ground potential.

The n-channel type MOS transistor Q5 in the reset pulse generating circuit 130 is turned off when the logic level of the gate signal GT5 supplied from the panel drive control circuit 12 is equal to "0". When the logic level of the gate signal GT5 is equal to "1", the MOS transistor Q5 is turned on applies the electric potential at the negative side terminal of the DC power source B2 onto a line 300 through the resistor R1. The positive side terminal of the DC power source B2 is connected to the ground.

A p-channel type MOS transistor Q7 serving as a switching device is turned on when a logic level of a gate signal GT7 supplied from the panel drive control circuit 12 is equal to "0", thereby connecting the lines 150 and 300. In this instance, the row electrode driving signal generated on the line 150 is supplied to the row electrodes $Y_1$ to $Y_n$ of the PDP 20 through the line 300, respectively. When the logic level of the gate signal GT7 is equal to "1", the MOS transistor Q7 is turned off, thereby disconnecting the lines 150 and 300. In this instance, only the row electrode driving signal generated on the line 300 is supplied to the row electrodes $Y_1$ to $Y_n$ of the PDP 20, respectively.

FIGS. 8A to 8G are diagrams showing the timings of the gate signals GT1 to GT5 and GT7 and waveforms of the row electrode driving signals which are generated on the line 300 in response to those gate signals GT.

FIGS. 8A to 8G are diagrams showing supplying timings of the gate signals GT1 to GT5 and GT7 when the reset pulse RPy and maintaining pulse IPy as shown in FIGS. 6A to 6F are generated, respectively.

Figures 8A, 8B, 8C, 8D, 8E, 8F, 8G:
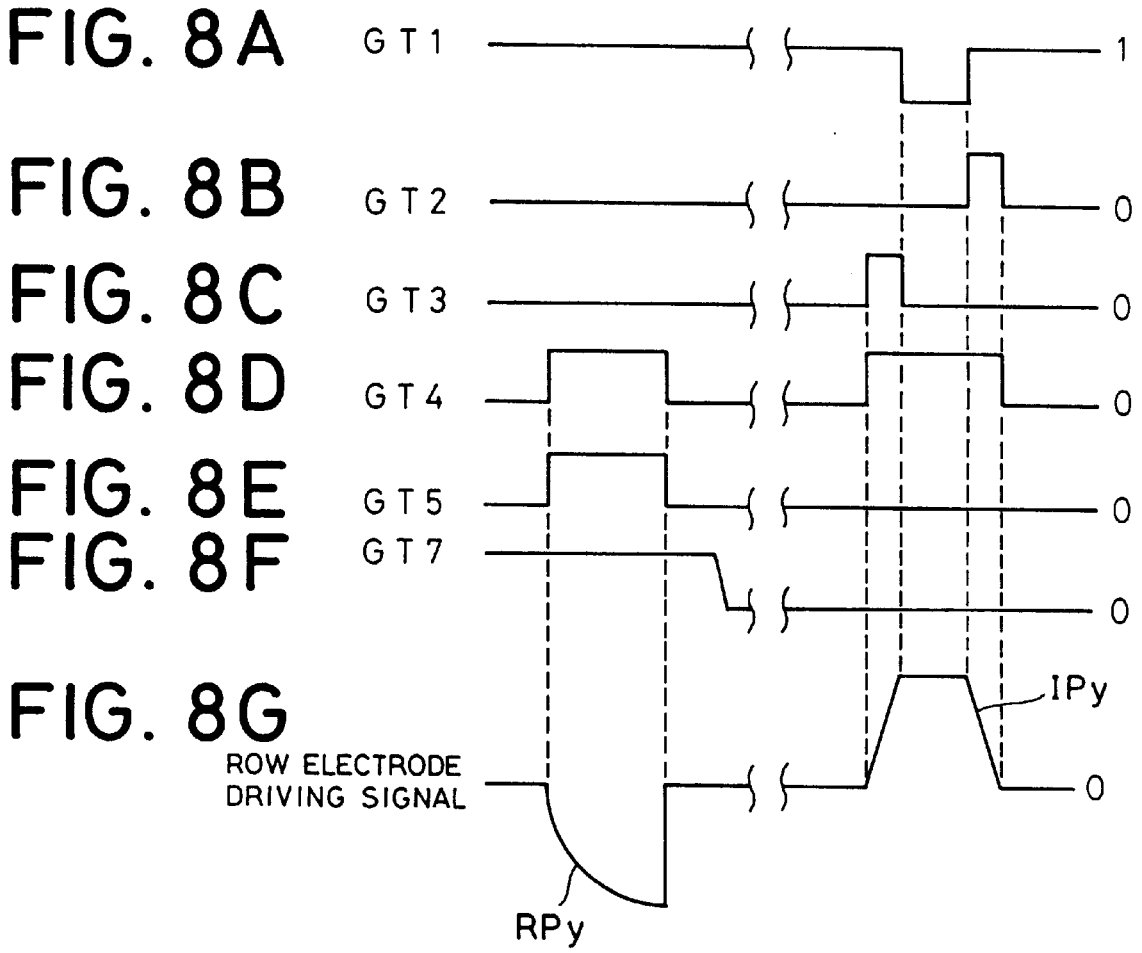
FIGS. 8A to 8G are diagrams showing timings of respective gate signals when the reset pulse RPy and maintaining pulse IPy are generated by the pulse driving circuit shown in FIG. 7.

As shown in FIG. 8E, the MOS transistor Q5 shown in FIG. 7 is first turned on in response to the gate signal GT5 at the logic level "1". The negative electric potential generated at the negative side terminal of the DC power source B2 is, therefore, applied onto the line 300 through the resistor R1. The reset pulse RPy of the negative voltage as shown in FIG. 8G is supplied to the row electrode Y of the PDP 20. In this instance, a waveform of a front edge portion of the reset pulse RPy becomes gentle owing to the operation of the resistor R1. For this period of time, since the gate signal GT7 at the logic level "1" is supplied to the MOS transistor Q7 shown in FIG. 7, the MOS transistor Q7 is OFF. For at least a period of time while the reset pulse RPy is generated, the lines 150 and 300 are in a disconnected state.

As shown in FIGS. 8B and 8C, subsequently, since the logic level of the gate signal GT3 is sequentially switched to "0"→"1"→"0" and the logic level of the gate signal GT3 is sequentially switched to "0"→"1"→"0" and, further, the logic level of the gate signal GT2 is sequentially switched to "0"→"1"→"0", the maintaining pulse IPy of the positive voltage as shown in FIG. 8G is generated. That is, the MOS transistor Q3 is first turned on in response to the gate signal GT3 at the logic level "1". The current according to the charges accumulated in the capacitor C1 flows onto the line 150 through the MOS transistor Q3, diode D2, and coil L2. In this instance, since the gate signal GT7 at the logic level "0" is supplied to the MOS transistor Q7 as shown in FIG. 8F, the MOS transistor Q7 is turned on, thereby connecting the lines 150 and 300. The level of the row electrode driving signal on the line 300 gradually rises as shown in FIG. 8G. Subsequently, the MOS transistor Q1 is turned on in response to the gate signal GT1 at the logic level "1", so that the positive electric potential at the positive side terminal of the DC power source B1 is applied onto the line 300 through the line 150 and MOS transistor Q7. The maintaining pulse IPy having the positive voltage as shown in FIG. 8G is generated. The MOS transistor Q2 is subsequently turned on in response to the gate signal GT2 at the logic level "1". The current according to the charges charged in the PDP 20 flows into the capacitor C1 through the MOS transistor Q2, diode D1, and coil L1. By the charging operation of the capacitor C1 as mentioned above, the level of the maintaining pulse IPy gradually drops as shown in FIG. 8G.

As mentioned above, in the pulse driving circuit shown in FIG. 7, the MOS transistor Q7 which is turned on for at least a period of time when the maintaining pulse is supplied to the row electrode is provided between the maintaining pulse generating circuit 120 and reset pulse generating circuit 130.

According to the above construction, the number of MOS transistors which are serially connected between the positive side terminal of the DC power source B1 and the negative side terminal of the DC power source B2 and, further, between the capacitor C1 for generating almost the same electric potential as that at the positive side terminal of the DC power source B1 and the negative side terminal of the DC power source B2 is increased by only one stage corresponding to only the MOS transistor Q7.

Figure 9:
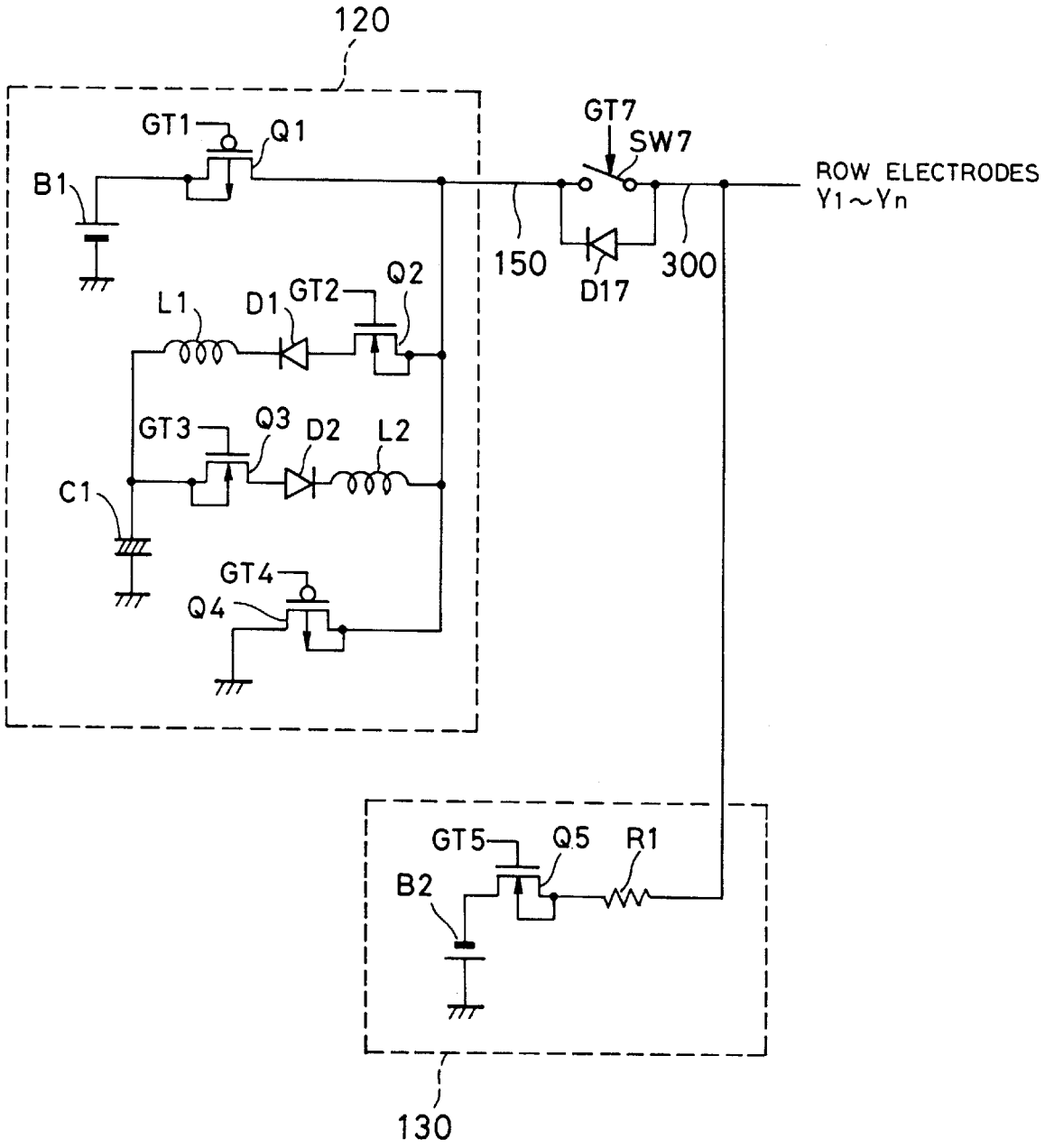
FIG. 9 is a diagram showing a construction of the pulse driving circuit based on the invention in which an MOS transistor Q7 is shown by an equivalent circuit.

The withstanding voltage per stage of the MOS transistor can be, consequently, reduced as compared with that in the conventional construction as shown in FIG. 3. The MOS transistor Q7 shown in FIG. 7 is equivalently constructed, as shown in FIG. 9, by a switch SW7 for connecting or disconnecting the lines 150 and 300 in accordance with the gate signal GT7 and a parasitic diode D17 formed in the forward direction from the line 300 to the line 150.

In this instance, the parasitic diode D17 prevents the current which reversely flows from the ground potential to the negative side terminal of the DC power source B2 of the maintaining pulse generating circuit 120 through a parasitic diode of the MOS transistor Q4.

That is, the diode D3 for prevention of the reverse current flow used in the construction in FIG. 3 for the purpose of the above function is unnecessary in the construction shown in FIG. 7.

In the above embodiment, to improve the withstanding voltage, the MOS transistor Q7 which is turned on at least for a period of time of generation of the maintaining pulse is provided on the line 150 as an output line of the maintaining pulse generating circuit 120. A MOS transistor for improvement of the withstanding voltage can be also provided for an output line of each pulse generating circuit.

Figure 10:
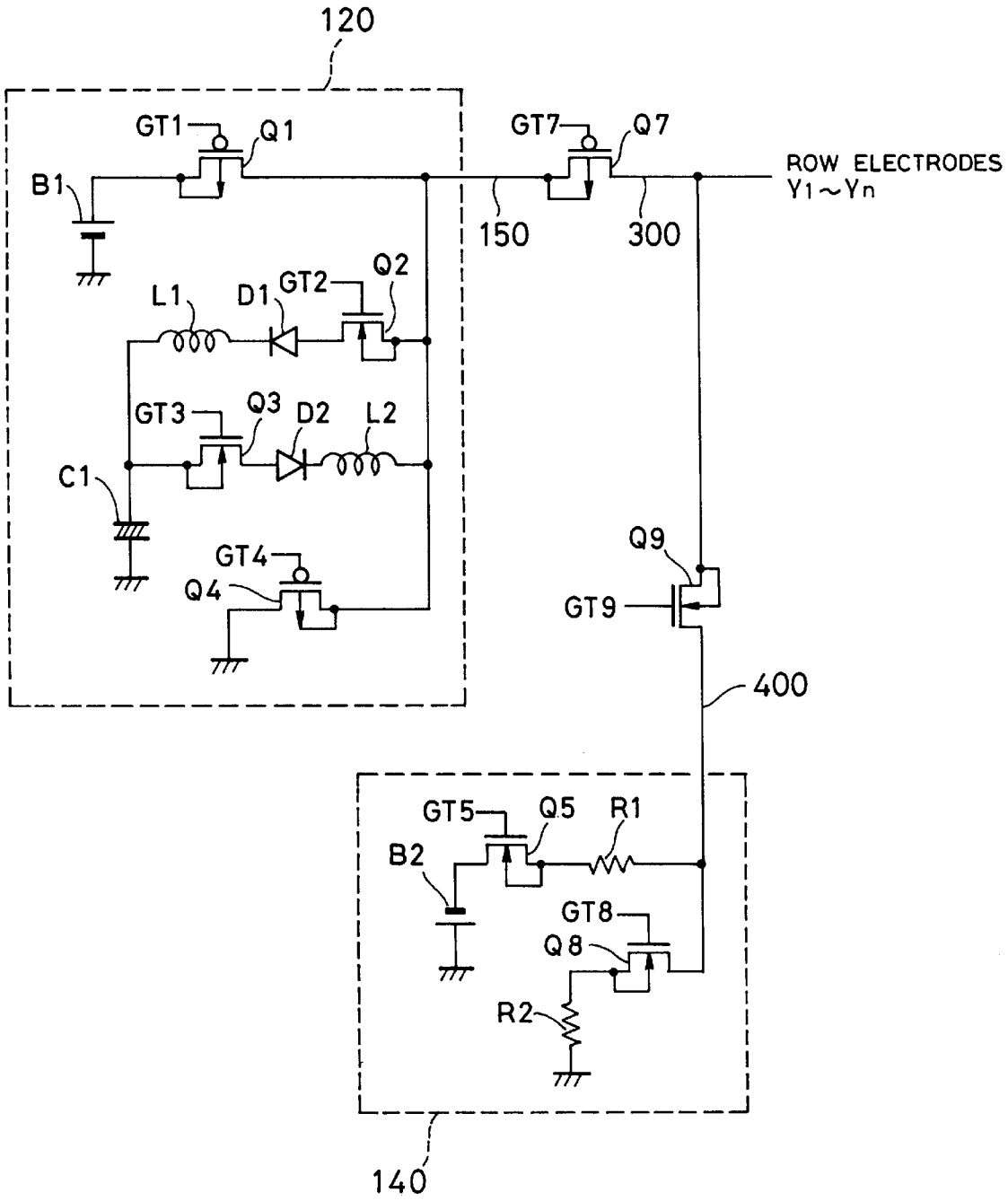
FIG. 10 is a diagram showing another constructional example of the pulse driving circuit based on the driving apparatus of the invention.

FIG. 10 is a diagram showing a construction of a pulse driving circuit realized in consideration of the above problem.

The description of the maintaining pulse generating circuit 120 and MOS transistor Q7 shown in FIG. 10 is omitted here because they are the same as those shown in FIG. 7 mentioned above.

In FIG. 10, the n-channel type MOS transistor Q5 in a reset pulse generating circuit 140 is turned off when the logic level of the gate signal GT5 supplied from the panel drive control circuit 12 is equal to "0" on. When the logic level of the gate signal GT5 is equal to "1", the MOS transistor Q5 is turned on, thereby applying the electric potential at the negative side terminal of the DC power source B2 onto a line 400 through the resistor R1. The positive side terminal of the DC power source B2 is connected to the ground. Further, an n-channel type MOS transistor Q8 in the reset pulse generating circuit 150 is turned off when the logic level of a gate signal GT8 supplied from the panel drive control circuit 12 is equal to "0". When the logic level of the gate signal GT8 is equal to "1", the MOS transistor Q8 is turned on, thereby pulling an electric potential on the line 400 into the ground potential through the resistor R2.

An n-channel type MOS transistor Q9 serving as a switching device is turned on when the logic level of a gate signal GT9 supplied from the panel drive control circuit 12 is equal to "1", thereby connecting the lines 400 and 300. In this instance, a row electrode driving signal generated on the line 400 is supplied to the row electrodes $Y_1$ to $Y_n$ of the PDP 20 through the line 300, respectively. When the logic level of the gate signal GT9 is equal to "0", the MOS transistor Q9 is turned off, thereby disconnecting the lines 400 and 300.

FIGS. 11A to 11I are diagrams showing supplying timings of the gate signals GT1 to GT5 and gate signals GT7 to GT9 for generating the reset pulse RPy and maintaining pulse IPy in the construction shown in FIG. 10, respectively.

Figures 11A, 11B, 11C, 11D, 11E, 11F, 11G, 11H, 11I:
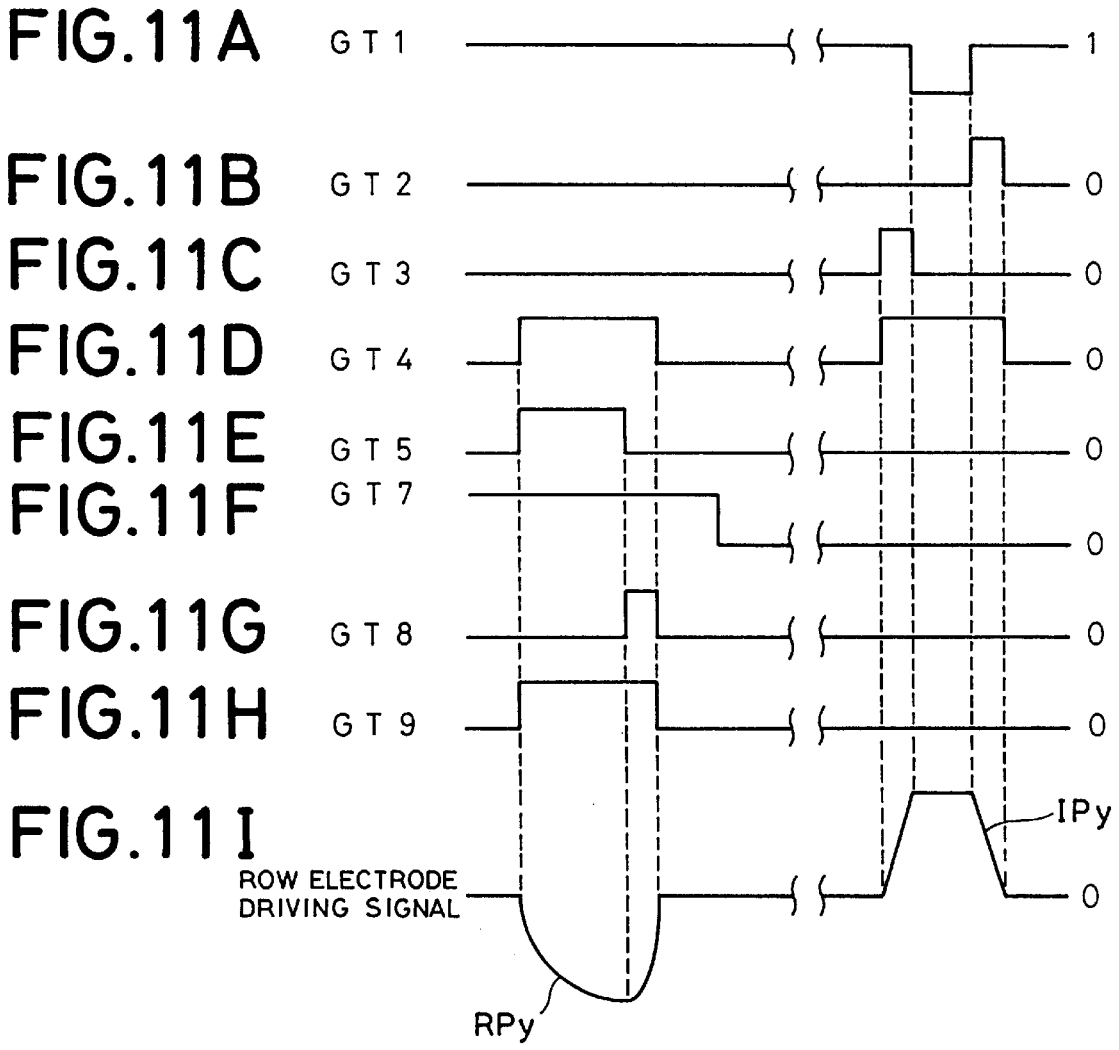
FIGS. 11A to 11I are diagrams showing timings of respective gate signals when the reset pulse RPy and maintaining pulse IPy are generated by the pulse driving circuit shown in FIG. 10.

As shown in FIG. 11E, first, the MOS transistor Q5 in the reset pulse generating circuit 140 shown in FIG. 10 is turned on in response to the gate signal GT5 at the logic level "1". The negative potential generated at the negative side terminal of the DC power source B2 is, thus, applied onto the line 400 through the MOS transistor Q5 and resistor R1. For this period of time, since the gate signal GT9 at the logic level "1" is supplied to the MOS transistor Q9 shown in FIG. 10, the MOS transistor Q9 is ON. The electric potential applied onto the line 400, therefore, is supplied to the line 300 via the MOS transistor Q9 and the reset pulse RPy of the negative voltage as shown in FIG. 11I is applied to the row electrode Y of the PDP 20. As shown in FIGS. 11E and 11G, when the logic level of the gate signal GT5 is switched from "1" to "0" and the logic level of the gate signal GT8 is switched from "0" to "1", the MOS transistor Q5 is switched to OFF and the MOS transistor Q8 is switched to ON, respectively. Since the MOS transistor Q8 is switched to ON, the reset pulse RPy of the negative voltage generated on the line 300 as shown in FIG. 11I is gradually pulled into the ground potential.

For a period of time when the reset pulse RPy is supplied to the row electrode Y of the PDP 20 through the line 400, MOS transistor Q9, and line 300, the gate signal GT7 at the logic level "1" is supplied to the MOS transistor Q7. For this period, therefore, the lines 150 and 300 serving as an output line of the maintaining pulse generating circuit 120 are disconnected.

As shown in FIGS. 11B and 11C, since the logic level of the gate signal GT3 is sequentially switched to "0"→"1"→"0" and the logic level of the gate signal GT3 is sequentially switched to "0"→"1"→"0" and, further, the logic level of the gate signal GT2 is sequentially switched to "0"→"1"→"0", the maintaining pulse IPy of the positive voltage as shown in FIG. 11I is generated. That is, the MOS transistor Q3 is first turned on in response to the gate signal GT3 at the logic level "1" and the current according to the charges accumulated in the capacitor C1 flows onto the line 150 through the MOS transistor Q3, diode D2, and coil L2. In this instance, as shown in FIG. 11F, since the gate signal GT7 at the logic level "0" is supplied to the MOS transistor Q7, the MOS transistor Q7 is turned on and the lines 150 and 300 are connected. The level of the row electrode driving signal on the line 300, consequently, gradually rises as shown in FIG. 11I. Subsequently, the MOS transistor Q1 is turned on in response to the gate signal GT1 at the logic level "1". The positive potential at the positive side terminal of the DC power source B1, therefore, is applied onto the line 300 through the line 150 and MOS transistor Q7 and the maintaining pulse IPy having the positive voltage as shown in FIG. 11I is generated. The MOS transistor Q2 is subsequently turned on in response to the gate signal GT2 at the logic level "1". The current according to the charges charged in the PDP 20, therefore, flows into the capacitor C1 through the MOS transistor Q2, diode D1, and coil L1. By the charging operation of the capacitor C1 mentioned above, the level of the maintaining pulse IPy gradually drops as shown in FIG. 11I. For a period of time when the maintaining pulse IPy is applied to the row electrode Y of the PDP 20 through the line 150, MOS transistor Q7, and line 300, the gate signal GT9 at the logic level "1" is supplied to the MOS transistor Q9. For this interval, thus, the lines 400 and 300 serving as an output line of the reset pulse generating circuit 150 are disconnected.

In the pulse driving circuit shown in FIG. 10, the MOS transistor (Q7, Q9) which is turned on for at least a period of time when each pulse generating circuit generates the driving pulse is provided for each output line of the pulse generating circuit (120, 140).

According to the above construction, therefore, the number of stages of the MOS transistors which are serially connected between the pulse generating circuits is further increased by only one stage (corresponding to the MOS transistor Q9), so that the withstanding voltage of each MOS transistor can be set to a value lower than that in the construction shown in FIG. 7.

What is claimed is:

1. A driving apparatus of a plasma display panel comprising column electrode driving means for applying a pixel data pulse corresponding to pixel data to a plurality of column electrodes arranged in the vertical direction of the plasma display panel and row electrode driving means for applying a first pulse of a predetermined polarity and a second pulse of a polarity different from said predetermined polarity to a plurality of row electrodes arranged in the horizontal direction which cross said column electrodes, respectively, wherein said row electrode driving means comprises:

a first pulse generating circuit for generating said first pulse and supplying said first pulse to a first line;

a second pulse generating circuit for generating said second pulse and supplying said second pulse to said row electrodes; and a switching device which is turned on for at least a period of time when said first pulse generating circuit generates said first pulse, thereby connecting said first line and said row electrodes, wherein said switching device is turned off for a period of time when said second pulse generating circuit generates said second pulse, thereby disconnecting said first line and said row electrodes.

2. An apparatus according to claim 1, wherein said first pulse generating circuit has a first DC power source for generating a positive electric potential and a p-type MOS transistor for applying said positive electric potential onto said first line in order to generate said first pulse, said second pulse generating circuit has a second DC power source for generating a negative electric potential and an n-type MOS transistor for applying said negative electric potential to said row electrodes in order to generate said second pulse, and said switching device is a p-type MOS transistor which is turned on for at least a period of time when said first pulse generating circuit applies said positive electric potential onto said first line, thereby connecting said first line and said row electrodes.

3. An apparatus according to claim 1, wherein said first pulse is a maintaining pulse of a positive voltage and said second pulse is a reset pulse of a egative voltage.

4. An apparatus according to claim 2, wherein said first pulse is a maintaining pulse of a positive voltage and said second pulse is a reset pulse of a negative voltage.

5. A driving apparatus of a plasma display panel comprising column electrode driving means for applying a pixel data pulse corresponding to pixel data to a plurality of column electrodes arranged in the vertical direction of the plasma display panel and row electrode driving means for applying a first pulse of a predetermined polarity and a second pulse of a polarity different from said predetermined polarity to a plurality of row electrodes arranged in the horizontal direction which cross said column electrodes, respectively, wherein said row electrode driving means comprises:

a first pulse generating circuit for generating said first pulse and supplying said first pulse to a first line;

a first switching device which is turned on for at least a period of time when said first pulse generating circuit generates said first pulse, thereby connecting said first line and said row electrodes;

a second pulse generating circuit for generating said second pulse and supplying said second pulse to a second line; and a second switching device which is turned on for at least a period of time when said second pulse generating circuit generates said second pulse, thereby connecting said second line and said row electrodes, wherein said first switching device is turned off for a period of time when said second pulse generating circuit generates said second pulse, thereby disconnecting said first line and said row electrodes.

6. An apparatus according to claim 5, wherein said second switching device is turned off for a period of time when said first pulse generating circuit generates said first pulse, thereby disconnecting said second line and said row electrodes.

7. An apparatus according to claim 5, wherein said first pulse generating circuit has a first DC power source for generating a positive electric potential and a p-type MOS transistor for applying said positive electric potential onto said first line in order to generate said first pulse, said second pulse generating circuit has a second DC power source for generating a negative electric potential and an n-type MOS transistor for applying said negative electric potential onto said second line in order to generate said second pulse, said first switching device is a p-type MOS transistor which is turned on for at least a period of time when said first pulse generating circuit applies said positive electric potential onto said first line, thereby connecting said first line and said row electrodes, and said second switching device is an n-type MOS transistor which is turned on for at least a period of time when said second pulse generating circuit applies said negative electric potential onto said second line, thereby connecting said second line and said row electrodes.

8. An apparatus according to claim 5, wherein said first pulse is a maintaining pulse of a positive voltage and said second pulse is a reset pulse of a negative voltage.

9. An apparatus according to claim 7, wherein said first pulse is a maintaining pulse of a positive voltage and said second pulse is a reset pulse of a negative voltage.

* * * * *